United States Patent [19]

Fukutani

[11] Patent Number: 4,986,772

[45] Date of Patent: Jan. 22, 1991

[54] ELECTRICAL CONNECTOR HAVING TERMINALS AND RETAINER FOR PROTECTING THE TERMINALS DURING TRANSPORTATION

[75] Inventor: Iwao Fukutani, Nagaokakyo, Japan

[73] Assignee: Murata Manufacturing Co., Ltd., Kyoto, Japan

[21] Appl. No.: 302,324

[22] Filed: Jan. 27, 1989

[30] Foreign Application Priority Data

Jan. 27, 1988 [JP] Japan ..... 63-9247

[51] Int. Cl.[5] ..... H01R 23/70

[52] U.S. Cl. ..... 439/892; 174/138 G; 439/79; 439/893

[58] Field of Search ..... 439/55, 78, 79, 80, 439/271, 426, 586, 137, 149, 150, 892, 893; 174/77 R, 65.6, 138 G; 361/403; 206/326, 331

[56] References Cited

U.S. PATENT DOCUMENTS

| | | | |
|---|---|---|---|
| 1,933,592 | 11/1933 | Hubbell, Jr. | 439/137 |
| 2,820,088 | 1/1958 | Sperry | 174/153 |
| 3,427,550 | 2/1969 | Helda et al. | 206/311 |
| 3,456,232 | 7/1969 | Dupre | 439/426 |
| 3,516,044 | 6/1970 | Barnes et al. | 439/381 |
| 3,793,720 | 2/1974 | Van Rijsewijk | 439/893 |
| 4,629,269 | 12/1986 | Kailus | 439/587 |
| 4,840,571 | 1/1989 | Minata et al. | 439/271 |
| 4,875,862 | 10/1989 | Sakamoto et al. | 439/79 |

*Primary Examiner*—Neil Abrams
*Attorney, Agent, or Firm*—Wenderoth, Lind & Ponack

[57] ABSTRACT

A connector includes a connector body provided with a plurality of pin-like terminals and a retainer provided with through-holes, through which the terminals are passed, for maintaining regular pitches of the terminals and preventing the terminals from being deformed. The retainer is provided with a thin film formed so that it may be fractured by passing the terminal through at least one through-hole of a plurality of through-holes, and the fractured portion may be elastically engaged with an outer circumferential surface of the inserted terminal. Diameters of all of the through-holes including the above through-hole are adapted to be larger than an outside diameter of the terminals as taken along the entire axial length of the through-holes. Upon inserting the terminals of the connector body into the through-holes of the retainer, the thin film is fractured by the terminals and the fractured portion is elastically engaged with the outer circumferential surface of the inserted terminals to support the retainer by the terminals. In addition, since the diameter of all of the through-holes is adapted to be larger than that of the terminals, the tolerances of the diameter are easy to meet and the formation of the terminals during the production of the retainer can thus be made easy.

10 Claims, 4 Drawing Sheets

ELECTRICAL CONNECTOR HAVING TERMINALS AND RETAINER FOR PROTECTING THE TERMINALS DURING TRANSPORTATION

BACKGROUND OF THE INVENTION

1. Field of the Invention

The present invention relates to a connector mounted on, for example, a printed substrate, and in particular to a connector comprising a connector body provided with a plurality of pin-like terminals in combination with retainers mounted on said terminals for protecting them.

2. Description of the Related Art

A connector of this type has mere structure wherein a plurality of pin-like terminals 2 extend from a connector body 1, as shown in FIG. 14.

With such a connector, it is difficult to always maintain pitches of the respective terminals 2 constant and it hinders the installation thereof on a printed substrate under particular circumstances.

In addition, the terminals are fractured or deformed during the transportation of the connector under particular circumstances.

So, in order to solve such problems, a retainer 3 as shown, for example, in FIG. 15 has been used. This retainer 3 is provided with through-holes 4, through which a plurality of pin-like terminals 2 extending from the connector body 1 are passed. Accordingly, the pitches between the respective terminals 2 can be maintained constant by passing the respective terminals 2 through the through-holes 4. Furthermore, the terminals 2 can be prevented from being brought into contact with each other, whereby the terminals 2 can be prevented from being deformed.

However, such a retainer 3 is required to be held by the terminals 2 with the terminals 2 passed through the through-holes 4. So, a diameter of the through-holes 4 has been adapted to be almost equal to or slightly smaller than that of the terminals, that is, a so called "not-go insertion" has been adopted. Thus, a moderate frictional force is brought about between the terminal 2 and the through-hole 4 when the terminals 2 have been passed through the through-holes 4, whereby the retainer 3 is held by the terminals 2.

The not-go insertion has been applied to all through-holes 4 in some circumstances but in a case in which too severe of an engagement would occur if the terminals were passed through the through-holes 4 resulting in the terminals 2 being deformed, the not-go insertion has been applied to merely some of the through-holes 4, for example, the through-holes at four corners of the retainer.

According to the above-described prior art, the not-go insertion is applied to the through-holes 4, so that the tolerancing of the diameter of the formation of the through-holes 4 becomes very critical, whereby the processing operation of forming the through-holes 4 becomes difficult.

SUMMARY OF THE INVENTION

So, it is a first object of the present invention to provide a connector in which the exactness of the diameter of the through-holes formed in the retainer is not critical and therefore the through-holes can be easily formed in comparison with the prior art.

It is a second object of the present invention to provide a connector capable of surely holding the retainer via terminals of the connector and preventing the retainer from falling off of the terminals during transportation.

It is a third object of the present invention to provide a connector capable of surely maintaining pitches of the terminals and surely preventing the terminals from being deformed during transportation.

DETAILED DESCRIPTION OF THE PREFERRED EMBODIMENTS

Figure 1:
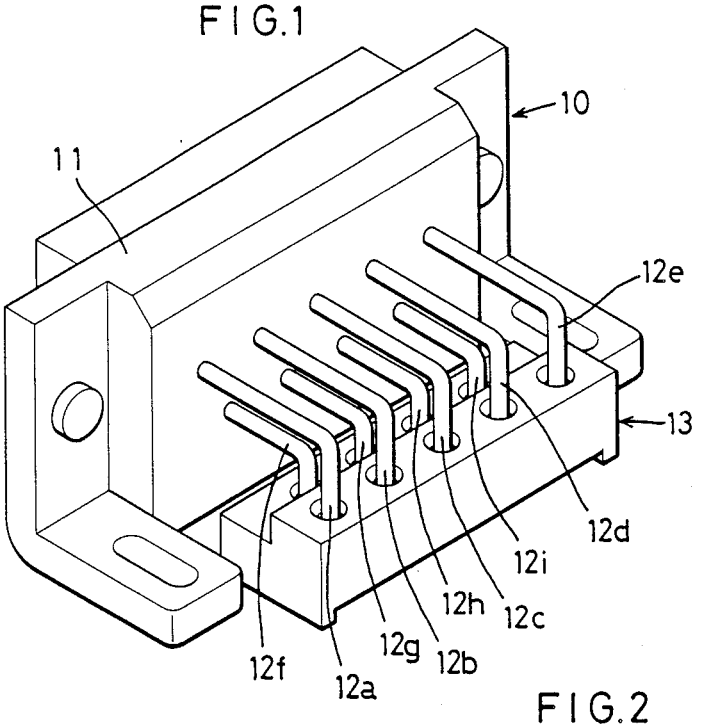
FIG. 1 is a perspective view of a connector unit according to the present invention.

As shown in FIG. 1, the connector is a right angle type and comprises a connector body 11, a plurality of (in this preferred embodiment 9) input and output pin-like terminals 12*a*, 12*b*, . . . 12*i* (designated by reference numeral 12 when referred to collectively) extending from said connector body 11 and a retainer 13 for maintaining pitches between the respective terminals 12 and preventing the terminals from being deformed during transportation. The terminals 12 are arranged in two rows, that is, an upper row and a lower row, the terminals 12*a* to 12*e* being offset from the terminals 12*f* to 12*i* in the direction of arrangement thereof.

These terminals 12 extend outward of the connector body 11, are nearly L-shaped, and have pointed ends passing through the retainer 13.

Figure 2:
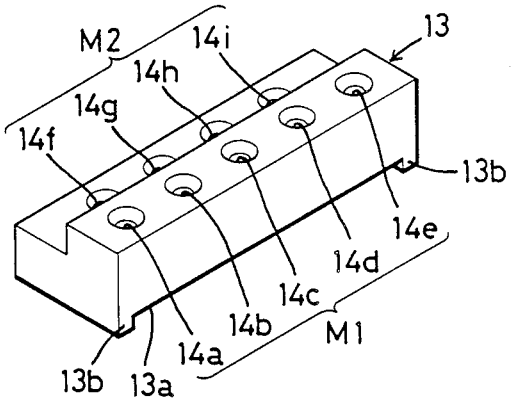
FIG. 2 is a perspective view of a first example of a retainer in the unit of FIG. 1.
Figure 3:
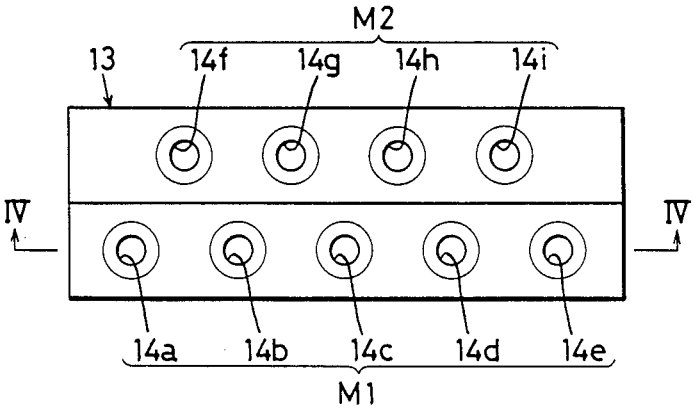
FIG. 3 is a plan view of the retainer of FIG. 2.
Figure 4:
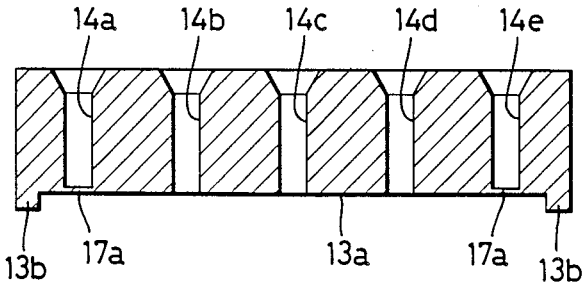
FIG. 4 is a longitudinal sectional view of the retainer as taken along line IV—IV of FIG. 3.

The retainer 13 of the first example shown in FIGS. 2 to 7 is formed of electrically insulative synthetic resin materials, such as nylon and polybutylene terephthalate with a glass ingredient added thereto, in a stepped shape as shown in FIG. 2, and provided with through-holes 14a, 14b, . . . 14i (designated by reference numeral 14 when referred to collectively) through which said terminals 12 are passed. The holes 14 are formed in an upper step and a lower step of the retainer. The through-holes 14a to 14e in the upper step are arranged on one straight line at appointed intervals, the straight line extending along a longitudinal direction of the retainer 13, and the through-holes 14f to 14i in the lower step are similarly arranged on one straight line extending along the longitudinal direction of the retainer 13. Furthermore, the row M1 of these through-holes in the upper step is offset from the row M2 of these through-holes in the lower step in the direction of arrangement corresponding to the arrangement of said terminals 12. In addition, the retainer 13 is provided with downward projecting leg members 13b formed on both ends of a lower surface 13a thereof.

However, the through-holes 14a, 14e positioned at both ends of the row M1 of the through-holes in the upper step have a slightly different configuration than the remaining through-holes 14b, 14c, 14d.

Figure 5:
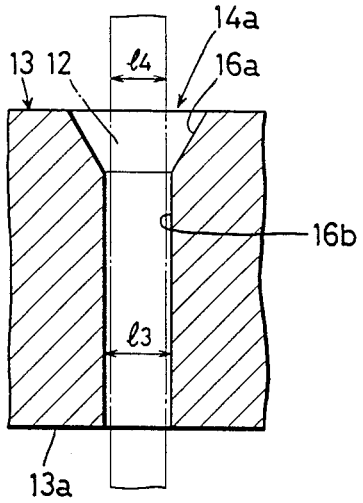
FIG. 5 is an enlarged sectional view of said retainer taken through a through-hole therein.

That is to say, the through-hole 14b is defined by a conical surface 16a tapered toward an outlet side and a straight cylindrical surface 16b contiguous with said conical surface 16a from the inlet side to the outlet. The conical surface 16a and the straight cylindrical surface 16b have a common axis. A diameter 13 of the straight cylindrical surface 16b is adapted to be larger than that 14 of the terminals 12 to an extent of "gap insertion". Also other through-holes 14c, 14d have the same configuration as the through-hole 14b, as shown in FIG. 5.

Figure 6:
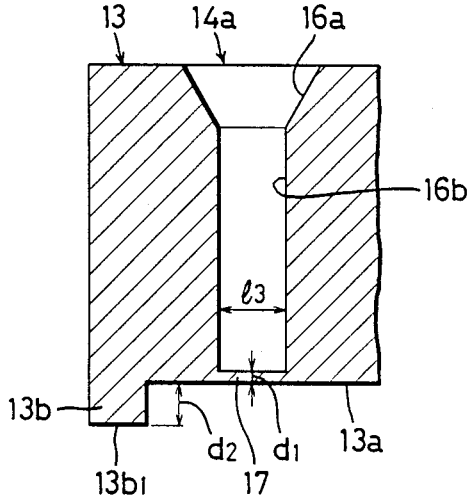
FIG. 6 is a similar enlarged sectional view of the retainer provided with a thin film.

On the other hand, the through hole 14a is defined by a conical surface 16a tapered toward an outlet side and a straight cylindrical surface 16b contiguous with said conical surface 16a from an inlet side to the outlet side, as shown in FIG. 6. A portion of the straight cylindrical surface 16b is provided on a thin film 17 covering the outlet and formed on the outlet side. A thickness d1 of this thin film 17 is selected so as to be able to be broken when the terminals 12 are passed therethrough.

The above-described thickness d1 of the thin film 17 is preferably selected depending upon a kind of material used for the formation of the retainer 13. For example, in the case where nylon with the glass ingredient added thereto is used, the thickness of the thin film 17 is preferably selected to be about 0.1 mm or less.

In addition, the other through-hole 14e has the same configuration as the through-hole 14a.

Such configurations of the through-holes 14a, 14e as well as the through-holes 14b, 14c, 14d are the same as those of the other row M2 of the through-holes, respectively.

Furthermore, the height d2 of the leg members 13b projecting from the bottom surface 13a is selected so as to be larger than ½ of the diameter 13 of the straight cylindrical surface 16b, whereby a broken portion 17a of the thin film 17 (refer to FIG. 7) is not projected downward of the bottom surface 13bl of the leg member 13b when the thin film 17 is broken. Thus, no hindrance occurs when the connector 10 is mounted on a printed substrate (not shown).

The operation of passing the terminals 12 through the retainer 13 having such structure is described below.

In order to pass the terminal 12b through the through hole 14b, at first the terminal 12b is guided to the end portion on the inlet side of the straight cylindrical surface 16b by the conical surface 16a and is then smoothly passed through the space defined within the straight cylindrical surface 16a because the diameter l3 of the straight cylindrical surface 16b is selected so as to be larger than that l4 of the terminals.

The operation of passing the terminals 12c, 12d, 12g, 12h through the remaining through holes 14c, 14d, 14g, 14h is the same as that of passing the terminal 12b through the through hole 14b.

Figure 7:
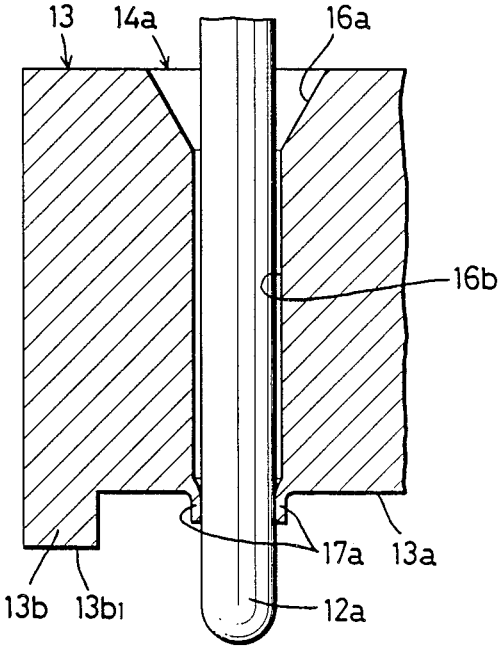
FIG. 7 is an enlarged sectional view of the retainer showing a condition in which a terminal has been passed through said through-hole.

On the other hand, when the terminal 12a is passed through the through hole 14a, the terminal 12a is smoothly put in the through hole 14a until the pointed end thereof arrives at the thin film 17 and then the insertion of the terminal 12a leads to the breakage of the thin film 17. At this time, as shown in FIG. 7, the broken portion 17a of the thin film 17 is elastically engaged with the outer circumferential surface of the terminal 12a to bring about a moderate frictional force between the broken portion 17a of the thin film 17 and the outer circumferential surface of the terminal 12a.

Also during the time when the terminals 12e, 12f, 12i are passed through the remaining through holes 14e, 14f, 14i the frictional force is simularly brought about. The terminals 12 are held by the retainer 13 by this frictional force.

The terminals 12 are passed through the retainer 13 and can be held in the above-described manner.

In addition, since the diameter l3 of the straight cylindrical surface 16b is selected to an extent of so called gap-insertion, the control of tolerancing the diameter is easy in comparision with "not-go insertion" in the prior art. Accordingly, the through holes 14 can be relatively easily formed in the retainer 13.

Figure 8:
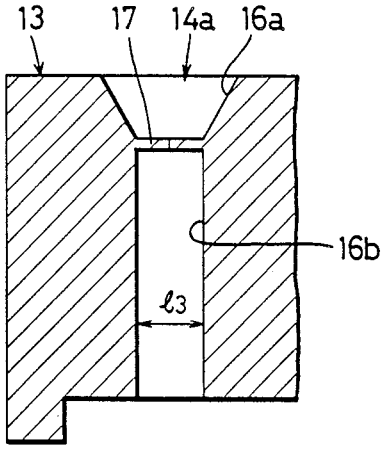
FIG. 8 is an enlarged sectional view of a modified version of the first example in which the thin film is formed at an inlet portion of the through-hole.
Figure 9:
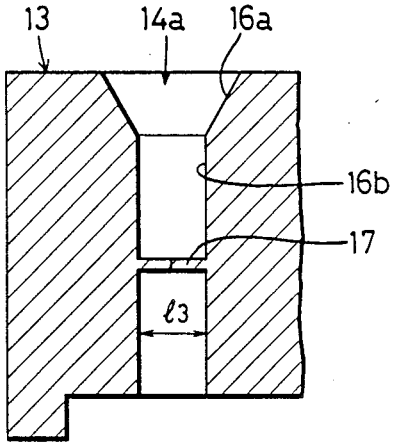
FIG. 9 is an enlarged sectional view of still a further modified version in which the thin film is formed in a middle portion of the through-hole.

In adddition, FIGS. 8, 9 are different from FIG. 6 with respect to the location of the thin film 17 of the retainer 13.

In FIG. 6 the thin film 17 is formed at the outlet portion of the straight cylindrical surface 16b of the through hole 14a but in fIG. 8 the thin film 17 is formed at the inlet portion of the straight cylindrical surface 16b while in FIG. 9 the thin film 17 is formed at the middle portion of the straight cylindrical surface 16b.

Figure 10:
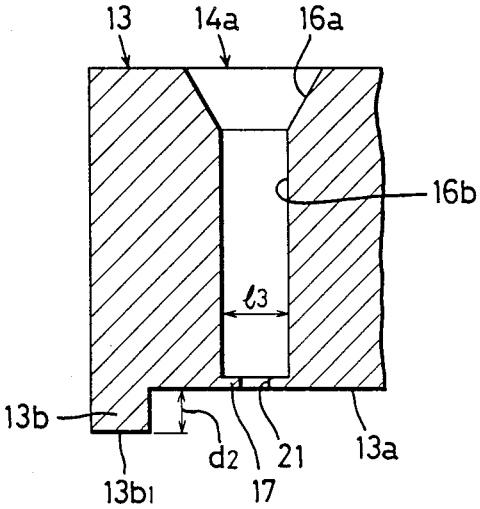
FIG. 10 is an enlarged sectional view of a second example of the retainer.
Figure 11:
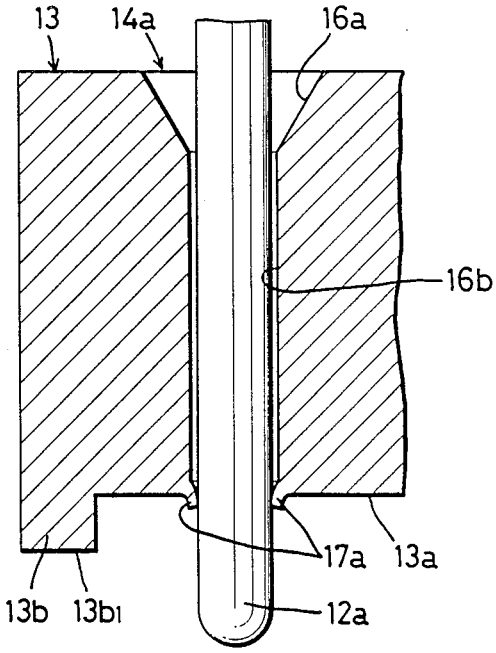
FIG. 11 is an enlarged sectional view of the retainer of FIG. 10 showing a condition in which a terminal has been passed through said through-hole.

Next, the second example of the retainer shown in FIGS. 10, 11 is described.

Since the structure of this second example is nearly identical with the first example shown in FIGS. 2 to 9 points of difference will be merely described.

Referring to FIG. 10, the retainer 13 of the second example is provided with a hole 21 having a diameter smaller than the outside diameter of the terminal 12a and formed at a center of the thin film 17 at the outlet side of the through hole 14a.

This hole 21, as shown in FIG. 11, serves to easily allow the thin film 17 to break when the terminal 12a is passed through the through hole 14a.

In addition, other through holes provided with the thin film 17 also are provided with the hole 21 formed in the thin film 17.

If the hole 21 is formed at the center of the thin film 17 in the above described manner, even though the thickness of the thin film 17 is large, the thin film 17 can be easily broken by the terminal 12a, whereby the thin film 17 can be easily formed.

That is to say, it is technically difficult to remarkably reduce the thickness of the thin film 17 when the retainer 13 is produced from synthetic resin materials but in this second example, the thin film 17 can be easily broken due to the hole 21 even though the thickness of the thin film 17 is large, whereby the formation of the thin film 17 becomes technically easy.

In FIG. 11 the diameter of the hole 21 of the thin film 17 is smaller than that of the terminal 12*a*, so that the broken portion 17*a* of the thin film 17 is elastically engaged with the outer circumferential surface of the terminal 12*a* to hold the termials 12 in the retainer 13 due to the frictional force brought about between the broken portion 17*a* and the outer circumferential surface of the terminal 12*a*.

Figure 12:
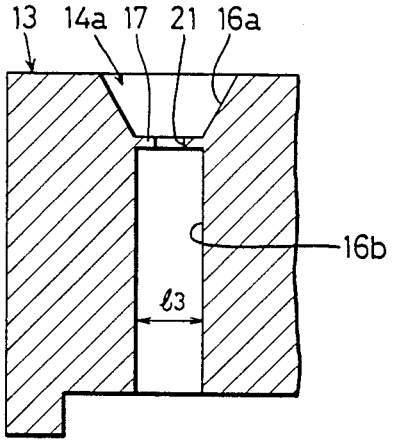
FIG. 12 is an enlarged sectional view of a modified version of the second example in which the thin film is formed on an inlet portion of the through-hole.
Figure 13:
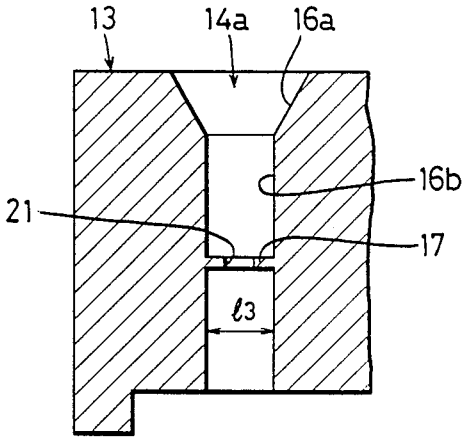
FIG. 13 is an enlarged sectional view of still a further modified version in which the thin film is formed in a middle portion of the through-hole.
Figure 14:
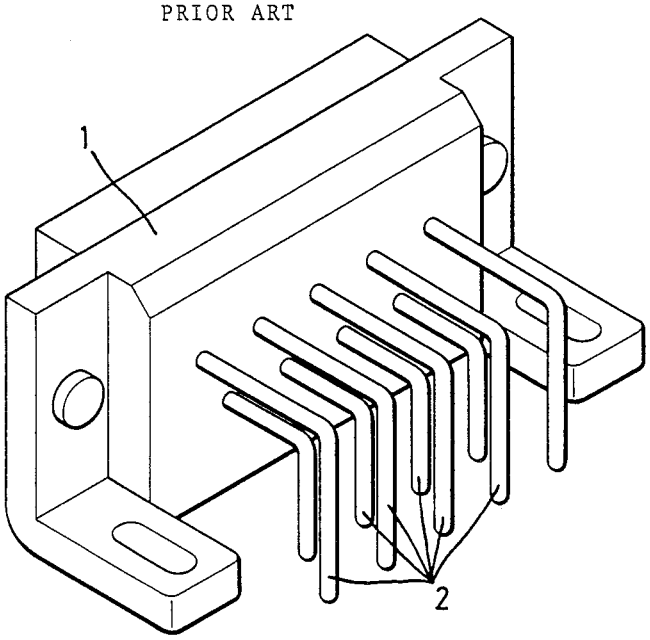
FIG.14 PRIOR ART
FIG. 14 is a perspective view of a conventional connector.
Figure 15:
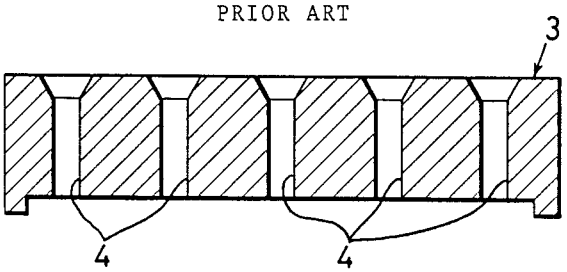
FIG.15 PRIOR ART
FIG. 15 is a longitudinal sectional view of a conventional retainer.

In addition, FIGS. 12, 13 are different from FIG. 10 with respect to the location at which the thin film 17 of the retainer 13 is formed.

In FIG. 10 the thin film 17 provided with the hole 21 is formed at the outlet portion of the straight cylindrical surface 16*b* of the through hole 14*a*, but in FIG. 12 said thin film 17 is formed at the inlet portion of the straight cylindrical surface 16*b*, while in FIG. 13 said thin film 17 is formed at the middle portion of the straight cylindrical surface 16*b*.

I claim:

1. A transportable unit comprising a right-angle type of electrical connector having a connector body, and a plurality of L-shaped spaced-apart terminals fixed to the connector body and extending there-from in the same direction; and retainer means being free of electrically conductive material for maintaining the spacing between said terminals and for preventing the terminals from being damaged during transportation of the unit, said retainer means comprising a retainer body defining a plurality of through-holes extending therethrough, said through-holes having diameters that are respectively larger than diameters of said terminals over axial length-wise portions of said terminals, said axial length-wise portions of the terminals extending into said through-holes, respectively, and said retainer body having a broken thin film extending into at least one of said through-holes, said thin film being deformed and in elastic engagement with the axial length-wise portion of the terminal that extends into said at least one through-hole such that said retainer means is removably secured to said connector via said elastic engagement the unit being directly mountable on a printed substrate to form a right-angle plug-in assembly.

2. The unit comprising a connector and retainer means as claimed in claim 1, wherein said at least one of said through-holes has an inlet and an outlet, the terminal having the axial length-wise portion that extends into said at least one through-hole extends through said inlet and has a terminal end projecting from said outlet, and said thin film is disposed at said outlet.

3. The unit comprising a connector and retainer means as claimed in claim 1, wherein said at least one of said through-holes has an inlet and an outlet, the terminal having the axial length-wise portion that extends into said at least one through-hole extends through said inlet and has a terminal end projecting from said outlet, and said thin film is disposed at said inlet.

4. The unit comprising a connector and retainer means as claimed in claim 1, wherein said at least one of said through-holes has an inlet and an outlet, the terminal having the axial length-wise portion that extends into said at least one through-hole extends through said inlet and has a terminal end projecting from said outlet, and said thin film is disposed within a middle range of said at least one through-hole located midway between said inlet and said outlet.

5. The unit comprising a connector and retainer means as claimed in claim 1, wherein said retainer consists of electrically insulative synthetic resin.

6. A transportable unit comprising a right-angle type of electrical connector having a connector body, and a plurality of L-shaped spaced-apart terminals fixed to the connector body and extending therefrom in the same direction; and retainer means being free of electrically conductive material for maintaining the spacing between said terminals and for preventing the terminals from being damaged during transportation of the unit, said retainer means comprising a retainer body defining a plurality of through-holes extending therethrough, said through-holes having diameters that are respectively larger than diameters of said terminals over axial length-wise portions of said terminals, said axial length-wise portions of the terminals extending into said through-holes, respectively, and said retainer body having a thin film extending into at least one of said through-holes, said thin film defining a hole therethrough at the center thereof that has a diameter smaller than the diameter of the axial length-wise portion of the terminal that extends into said at least one through-hole, said axial length-wise portion of the terminal that extends into said at least one through-hole also extending through said hole in the center of said thin film and deforming said thin film into elastic engagement therewith due to differences in the diameters of said hole and a local area of the axial length-wise portion of the terminal engaged with said thin film such that said retainer is removably secured to said connector via said elastic engagement the unit being directly mountable on a printed substrate to form a right-angle, plug-in assembly.

7. The unit comprising a connector and retainer means as claimed in claim 6, wherein said at least one of said through-holes has an inlet and an outlet, the terminal having the axial length-wise portion that extends into said at least one through-hole extends through said inlet and has a terminal end projecting from said outlet, and said thin film is disposed at said outlet.

8. The unit comprising a connector and retainer means as claimed in claim 6, wherein said at least one of said through-holes has an inlet and an outlet, the terminal having the axial length-wise portion that extends into said at least one through-hole extends through said inlet and has a terminal end projecting from said outlet, and said thin film is disposed at said inlet.

9. The unit comprising a connector and retainer means as claimed in claim 6, wherein said at least one of said through-holes has an inlet and an outlet, the terminal having the axial length-wise portion that extends into said at least one through-hole extends through said inlet and has a terminal end projecting from said outlet, and said thin film is disposed within a middle range of said at least one through-hole located midway between said inlet and said outlet.

10. The unit comprising a connector and retainer means as claimed in claim 6, wherein said retainer consists of electrically insulative synthetic resin.

* * * * *